US005178197A

United States Patent [19]

Healy

[11] Patent Number: 5,178,197

[45] Date of Patent: Jan. 12, 1993

[54] FUEL DISPENSING NOZZLE

[75] Inventor: James W. Healy, Hollis, N.H.

[73] Assignee: Healy Systems, Inc., Hudson, N.H.

[21] Appl. No.: 816,748

[22] Filed: Jan. 2, 1992

[51] Int. Cl.[5] ..... B67D 5/04

[52] U.S. Cl. ..... 141/217; 141/206; 141/302

[58] Field of Search ..... 141/206-229, 141/198, 392, 285, 295, 290-292, 296, 301, 302, 304, 305, 59; 222/52, 56, 59

[56] References Cited

U.S. PATENT DOCUMENTS

| | | | |
|---|---|---|---|
| 2,582,195 | 1/1952 | Duerr | 226/127 |
| 2,787,294 | 4/1957 | Carriol | 141/209 |
| 2,841,191 | 7/1958 | Fraser | 141/209 |
| 3,077,212 | 2/1963 | Hearn | 141/209 |
| 3,152,623 | 10/1964 | Carriol | 141/209 |
| 3,710,831 | 1/1973 | Riegel | 141/207 |
| 4,056,131 | 11/1977 | Healy | 141/206 |
| 4,057,086 | 11/1977 | Healy | 141/206 |
| 4,133,355 | 1/1979 | Mayer | 141/217 |
| 4,141,393 | 2/1979 | Mayer | 141/206 |
| 4,343,336 | 8/1982 | Trygg | 141/218 |
| 4,343,337 | 8/1982 | Healy | 141/226 |
| 4,453,578 | 6/1984 | Wilder | 141/209 |
| 4,559,982 | 12/1985 | Fink, Jr. | 141/206 |
| 4,572,255 | 2/1986 | Rabinovich | 141/217 |
| 4,658,987 | 4/1987 | Fink, Jr. | 222/52 |
| 4,735,243 | 4/1988 | Ehlers | 141/218 |

*Primary Examiner*—Henry J. Recla
*Assistant Examiner*—Casey Jacyna
*Attorney, Agent, or Firm*—Hayes, Soloway, Hennessey & Hage

[57] ABSTRACT

A pre-pay fuel system having a fuel nozzle with automatic cutoff provisions when a full tank exists or unwanted tank pressure conditions are detected is also provided with a low fuel pressure controlled cutoff. The fuel pressure cutoff allows rapid response to permit fuel flow when high pressure exists in the nozzle and provides a nozzle flow cutoff after a predetermined time delay when low fuel pressure exists in the nozzle.

15 Claims, 5 Drawing Sheets

FUEL DISPENSING NOZZLE

BACKGROUND OF THE INVENTION

The invention relates to fuel dispensing nozzles of the type described in my U.S. Pat. Nos. 4,056,131, 4,057,086, 4,343,377 and my co-pending application Ser. No. 07/706,807 filed May 29, 1991. The disclosures in each of the above patents and patent application is incorporated herein by reference.

The invention more particularly relates to a fuel dispensing nozzle which is utilized with a pre-pay self-service filling station. There have recently been developed nozzles having a pressure actuated poppet valve which automatically shuts off the dispensing nozzle shortly after the dispenser pump is de-energized when a "pre-paid" amount of fuel has been dispensed. This prevents further flow of fuel upon re-energizing of the pump supplying fuel to the nozzle. Examples of such devices are shown in U.S. Pat. Nos. to Fink 4,559,982 and 4,658,987.

SUMMARY OF THE INVENTION

It is an object of the present invention to provide a safety cut-off valve which is controlled by a decrease in pressure of the flowing fuel, such as when the fuel pump slows down as it approaches the "pre-paid" amount of fuel to be delivered. It will automatically close the valve when a lower pressure exists in the flowing fuel. In the present invention, a slight modification of the standard safety nozzle (which responds to a over full tank as well as one having a fuel fume vent with cut-off in response to over pressure or under pressure in the vapor conduit) is provided to also permit automatic nozzle shut-off after a pre-paid amount of gasoline is dispensed. The present invention also prevents the danger that, with the pre-pay mode of operation, a customer will holster the nozzle after the preset quantity of gasoline is delivered with a hold open clip engaged in the nozzle operating lever or with a lever holding the fuel valve open by placing the hand guard over the metal tab in the center of some nozzle hangers and then releasing the lever. In this case, the metal tab would prevent the nozzle from closing. In either case, the next user of the nozzle might grip the nozzle body handle and lever in the open state without realizing that the nozzle valve is open resulting in an unwanted and dangerous spray of gasoline when the pump is energized.

While the above patents to Fink provide a positive automatic disablement of the nozzle after the pre-determined amount of fuel has been delivered, they do not have the feature of the present invention which permits positive flow through the nozzle as soon as the fuel pressure rises and a pre-determined time delay before shut-off after fuel pressure falls and fuel flow has slowed as the pre-pay amount approaches.

Accordingly, it is a principal object of the present invention to provide a simple, fool-proof device for assuring fuel flow through the nozzle as soon as the fuel supply is pressurized and the hand operated valve is opened and to provide for a positive prevention of fuel flow within a pre-determined time after the fuel supply pressure is lowered as the pre-paid amount is approached.

DETAILED DESCRIPTION OF THE INVENTION

In order to more fully understand the present invention, reference should be had to the following detailed specification taken in connection with the following drawings wherein like numerals depict like parts, and wherein.

Figure 1:
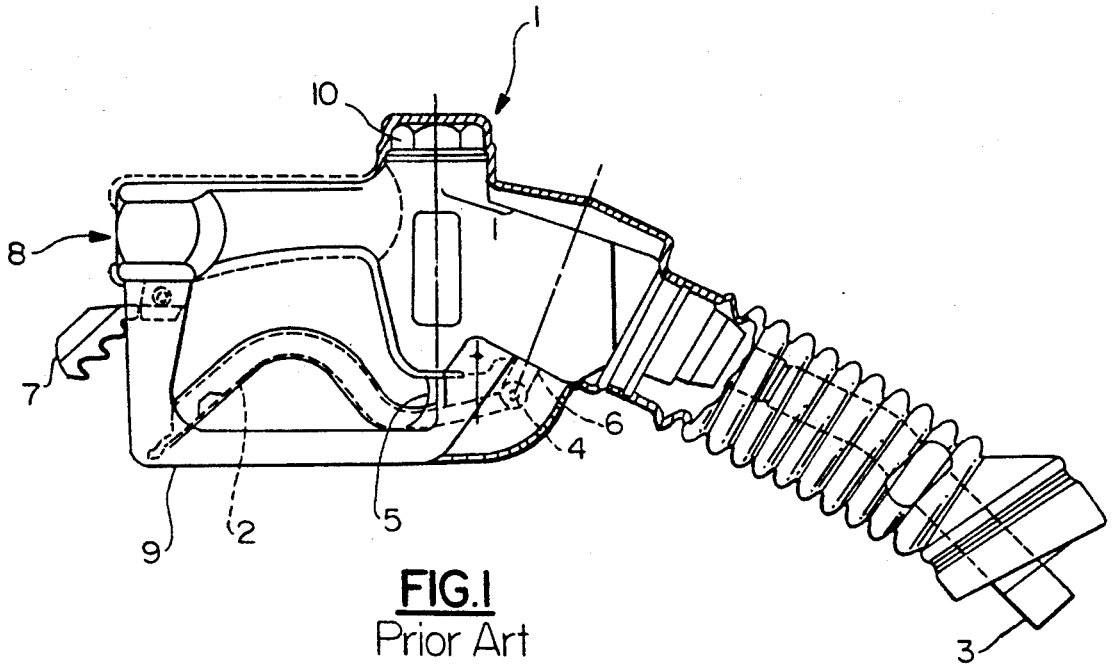
FIG.1 Prior Art
FIG. 1 is a schematic diagramatic outline view of a presently available commercial fuel nozzle.
Figure 2:
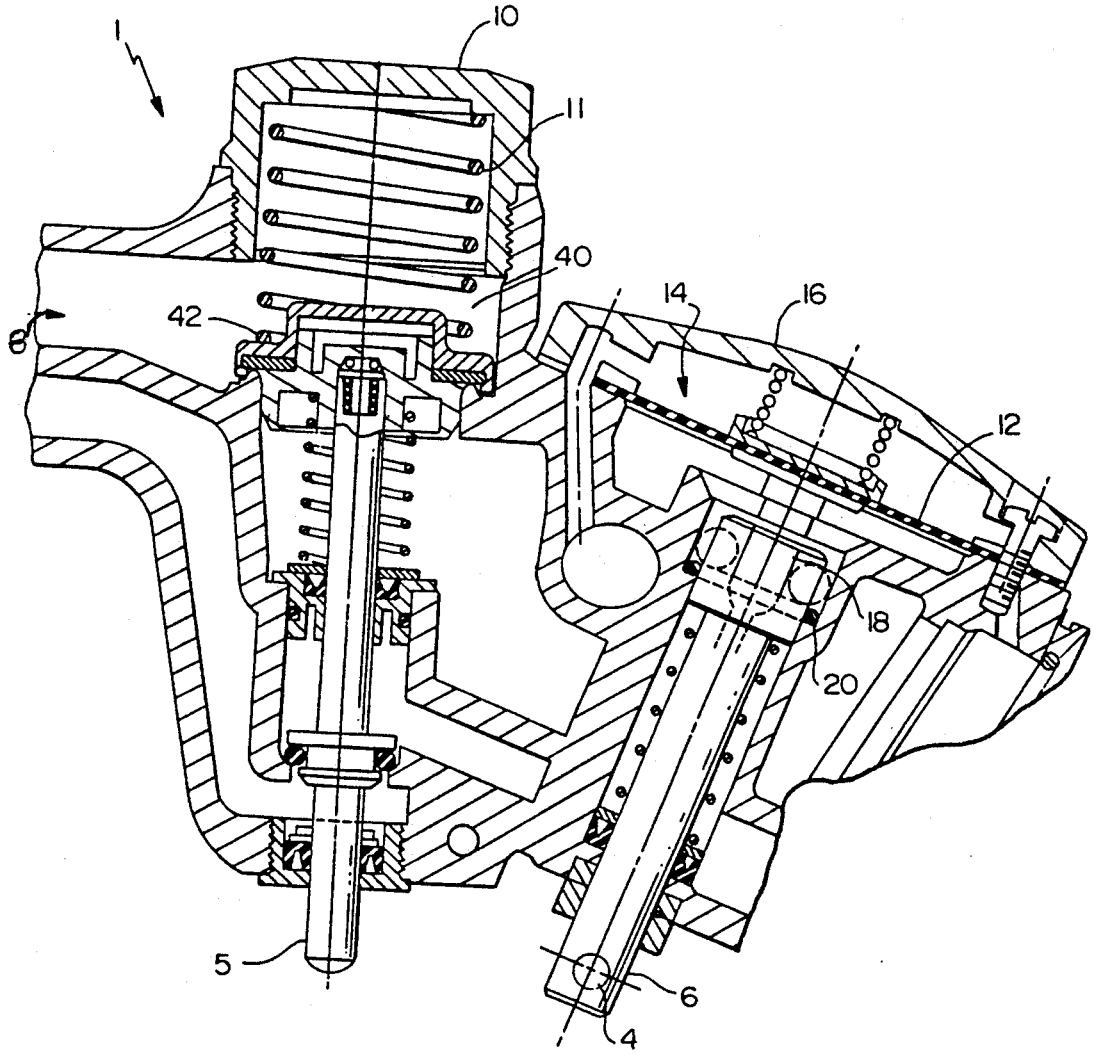
FIG.2 PRIOR ART
FIG. 2 is a sectional view of a portion of the internal valve arrangement of a commercially available fuel nozzle, this being FIG. 2 of the above co-pending application Ser. No. 07/706,807.

Referring now to FIGS. 1 and 2, there is illustrated one conventional commercial embodiment of a fuel nozzle currently sold under the designation of "Healy 400". This type of nozzle is described in more detail in my above mentioned co-pending application Ser. No. 07/706,807 filed May 29, 1991. These specific details of construction of the nozzle are set forth more fully in this co-pending application which is incorporated herein by reference. To understand the present invention, it is not necessary to have a complete understanding of all of the intricacies of the pending application. Suffice it to say that the nozzle described therein provides a negative pressure above the diaphragm 12 in FIG. 2 when the fill pipe of the vehicle being refueled is full of fuel or the tank is being filled too fast. It also is provided with a negative pressure when the vapor pressure in the tank is too high or too low. A diaphragm assembly for vapor regulation with a high and low pressure shut-off features is also shown in my prior U.S. Pat. No. 4,056,131.

In the operation of the above nozzle, in the standard system, a vacuum is produced in the volume 14 above the diaphragm 12 of FIG. 2 by a venturi aspirator (not shown) located in the nozzle spout assembly 1-3. When the nozzle is operating normally, the vacuum in the chamber 14 between the cover 16 and the diaphragm 12 is approximately 4" to 6" water column (WC). If the spout tip 3 within the vehicle fill pipe is covered by gasoline, the standard sensing port at the tip of the spout is blocked by liquid. The liquid blockage causes the vacuum over diaphragm 12 to rise rapidly and at approximately 25" WC the vacuum is sufficient to move the diaphragm 12 upwardly thus moving the pin 18 attached thereto. This disengages the ball-latch 20. This allows the valve stem 5 to be driven downwardly under the force of compression spring 11 associated with the fuel valve since the operating lever 3 is no longer restrained at it's forward pivot point 4 by the plunger 6. This is a normal operation of commercially available fuel valves, particularly of the type having vapor recovery systems associated therewith.

Figure 3:
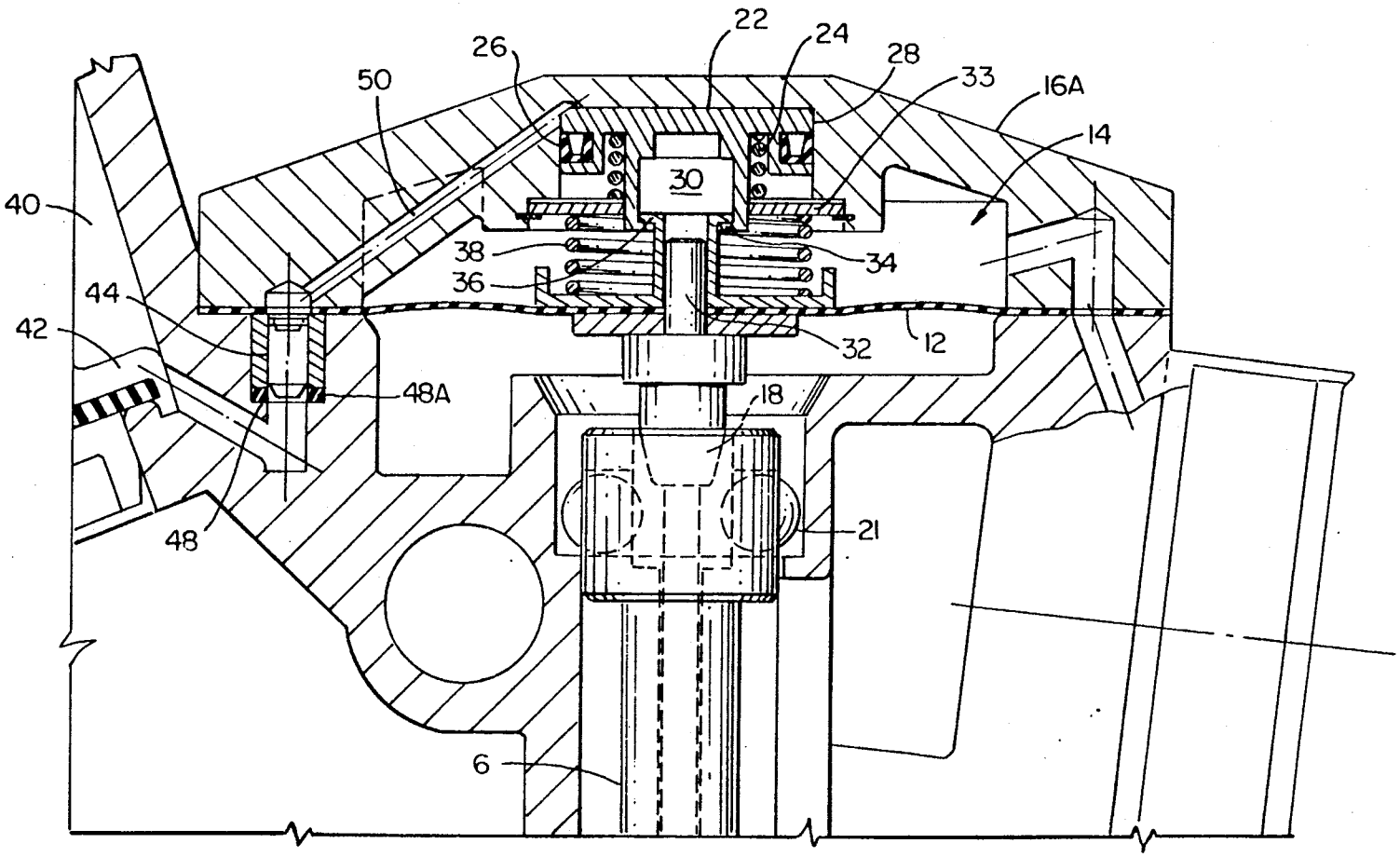
FIG. 3 is an enlarged sectional view of a portion of FIG. 2 showing a modification thereof illustrating one preferred embodiment of the present invention.

Referring now to FIG. 3, there is shown, in detail, a modification of the invention wherein the control of the latching pin 18 is also affected by the presence or lack thereof, of high pressure fuel in the fuel delivery line 8.

Figure 3A:
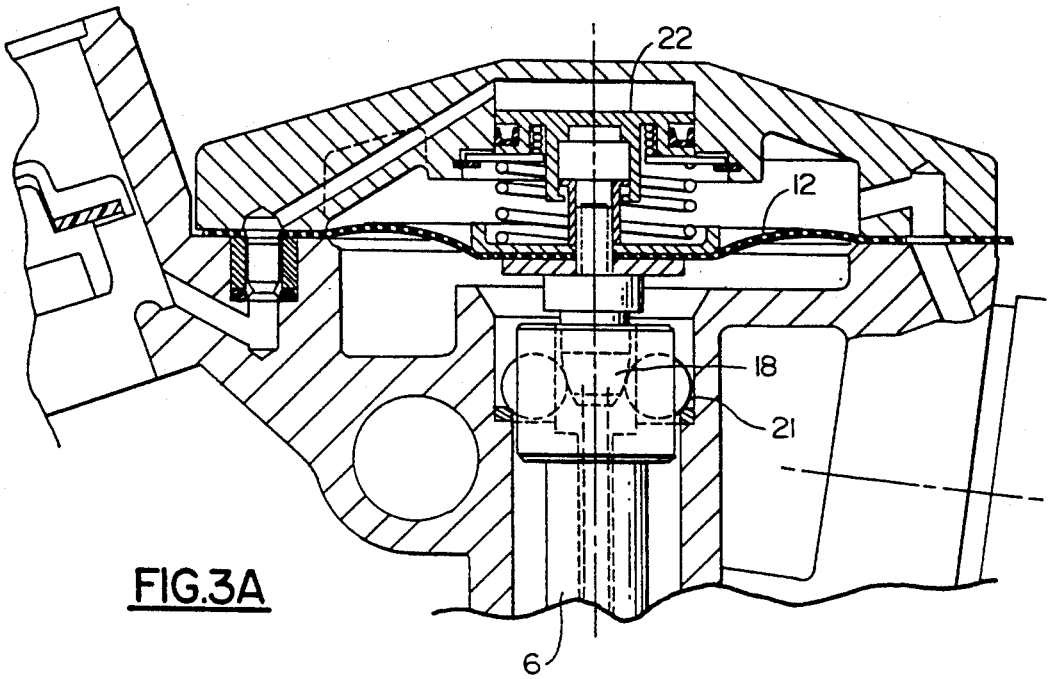
FIG. 3A is a sectional view identical to FIG. 3 except that the latch release valve mechanism is deactivated and fuel is being delivered to the vehicle tank.

As can be seen by examination of FIG. 3 the cap 16A on the diaphragm assembly has been modified to include provision for piston 22, preferrably co-axially mounted, with respect to the diaphragm 12, this piston 22 being normally held in an upwardly position against the cap 16A by means of a spring 24. A u-cup seal 26 seals the edges of the piston 22 within a cylinder 28 provided in the cap 16A. A sliding fit is provided at 30 between the piston 22 and an extension 32 secured to the top end of the ball control pin 18. When there is a low positive pressure (approximately 4 psi or less) within the cylinder 28 above the piston 22, the spring 24, supported by the washer 33, forces the piston 22 to the top of the cylinder 28. This lifts a shoulder 36 carried by the lower extension of the piston 22 which engages the shoulder 34 on the extension 32 to the latch control rod. This holds the latch control rod up out of ball engaging position so that the balls are free to move inwardly and therefore are not in a position to latch the forward pivot rod 6. When a high fuel pressure (approximately 8 psi or more) is applied to the cylinder 28 above the piston 22 it pushes this piston down against the compression of spring 24, thus releasing the latch pin 18 for downward movement under influence of the spring 38 which controls the normal position of the diaphragm 12. At this point, as illustrated in FIG. 3A, the balls 21 are in latch position and prevent the release of the forward pivot plunger 6.

Figure 4:
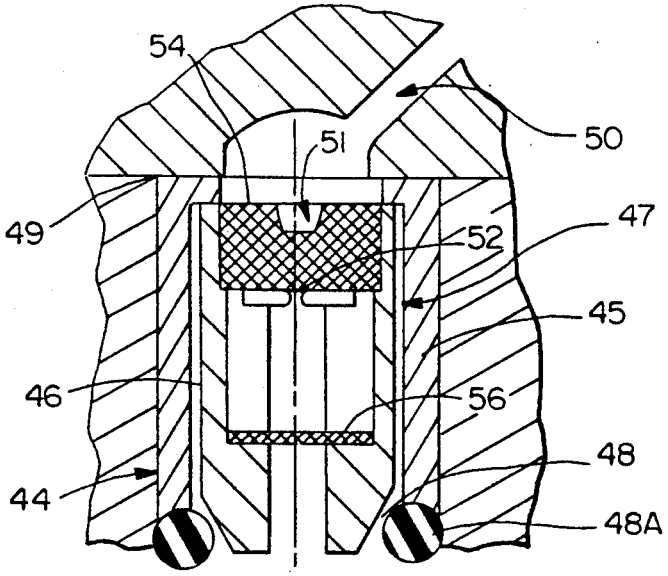
FIG. 4 is a detailed enlarged cross-sectional view of the by-pass fuel control valve for providing full fuel pressure to the ball-latching mechanism.

High pressure fuel in the space 40 above the main fuel control valve 42 (see FIG. 2) is fed to the cylinder 28 above latch rod control piston 22 through a two way valve generally indicated at 44. This valve comprises a by-pass piston 46 which is forced upwardly away from the valve seat 48 when high pressure exists in the gasoline supply line. By-pass piston 46 (see FIG. 4) loosely fits in a cylinder 45 to provide a space 47 therebetween. Space 47 is closed at the bottom by O-ring 48A adjacent the valve seat 48, and at the top by a lip 49 having a groove 51 which communicates with space 47 permitting fuel to flow into passage 50. This structure allows a rapid flow of gasoline past the valve seat 48 along side the loosely fitting by-pass piston 46 and into the passage 50 which communicates directly with the cylinder 28 above the latch control piston 22. When pressure in the nozzle 1 rises above 8 psi, the pressure is sufficiently great to overcome the force of spring 24 and starts to move the latch control piston 22 downwardly. This releases the latch rod 18 and the diaphragm 12 which can then be moved downwardly under the force of the spring 38 so that the tapered surface on the latch control rod 18 is in engagement with the balls 21 to hold them in latching position. (see FIG. 3A).

Figure 5:
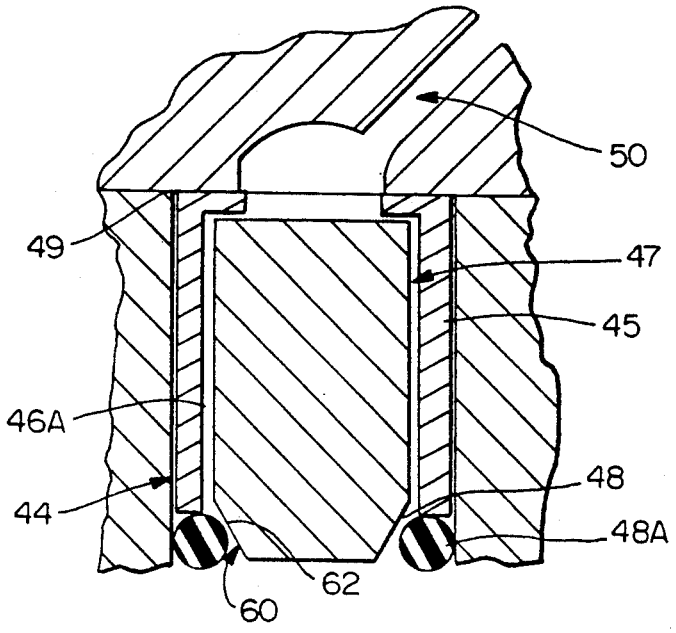
FIG. 5 is a detailed enlarged cross-sectional view of an alternative form of by-pass fuel control valve in accordance with the present invention.
Figure 6:
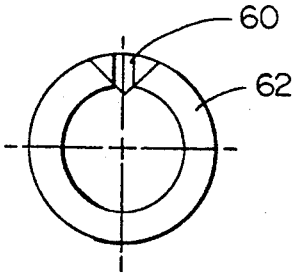
FIG. 6 is a plan view taken from the bottom and showing details of piston part of the by-pass fuel control valve of FIG. 5.

When the gasoline pressure falls below 6 psi in the cylinder 28 the compression spring 24 forces the piston 22 upward tending to purge the gasoline from this small, cylinder volume 28. While a quick action is desirable when moving the piston 22 to the latch position, the opposite is true for moving the piston 22 to the unlatching position. The by pass control valve 44 in the fuel supply line to the piston 22 provides this slow reverse fuel flow. As can be seen by further reference to FIG. 4, the by-pass piston 46 is hollow and has a small opening 52 in the center thereof. This opening 52 is shielded by filter screens 54 and 56 to prevent clogging thereof. The fuel in the chamber 28 above the piston 22 escapes only slowly through this very small opening 52 and accordingly, the movement of piston 22 is slowed sufficiently to provide 20–30 seconds delay before shoulder 36 reengages shoulder 34 and lifts the latch control rod 18 out of engagement with the balls 21 thereby releasing pivot plunger 6 thus disengaging the throttle valve handle 2. Alternatively, as shown in FIGS. 5 and 6, by-pass piston 46A may comprise a solid metal or ceramic plug and having an elongate notch 60 formed along a conical surface 62 thereof. Notch 60 may comprise any variety of cross-sectional shapes, but preferably comprises a 90° V-shaped notch of relatively small dimension, e.g., 0.003–0.004 inch deep. The small sharp notch will not seal when the piston is in contact with o-ring 48A thus providing for the slow escape of fuel to accomplish the 20–30 second time delay to unlatch.

A feature and advantage of employing a notched piston as shown in FIGS. 5 and 6 is that the notch is self-cleaning since gasoline flushes over it when the check valve is open during pressurized displacement of the piston 22.

To summarize the operation of the invention, at the conclusion of a prepay sale, the fuel dispenser will first shut off a high flow rate electric solenoid valve (usually at a point $0.10 to $0.15 less than the dollar amount requested by the customer) while holding open a slow flow rate solenoid valve to conclude the sale precisely to the penny requested before closure. It usually takes 10 seconds or so to finish the slow flow portion of the sale and, therefore, it is necessary to have the nozzle remain in the latched condition during this time, even though the fuel pressure in the supply line has fallen to 2 or 3 psi. The control of fuel flow into and out of the cylinder 28 occupied by the piston 22 is accomplished by the by pass bleed valve assembly 44.

When the fuel pressure in the nozzle rises above 8 psi, the bleed valve piston 46 on valve seat 48 is forced upward away from a sealing engagement with an o-ring 48A and fuel is free to flow around the piston 46 and upward into the cylinder 28 over piston 22. When fuel pressure in the nozzle falls below 6 psi the bleed valve piston 46 is forced into a sealing engagement with the o-ring 48A. At this point the only exit pathway for the fuel from above piston 22 is to flow through a 0.003 inch diameter orifice 52 in the bleed valve piston 46. The 0.003 inch diameter orifice 52 provides for slow upward movement of the piston 22, thus delaying the unlatching function. Typically, the unlatching action is delayed 20 to 30 seconds from the time the fast flow valve has closed. As can be appreciated, the flow path past the by-pass piston 46 is several orders of magnitude larger than the back flow through the small hole 52 in the by-pass piston.

Figure 3B:
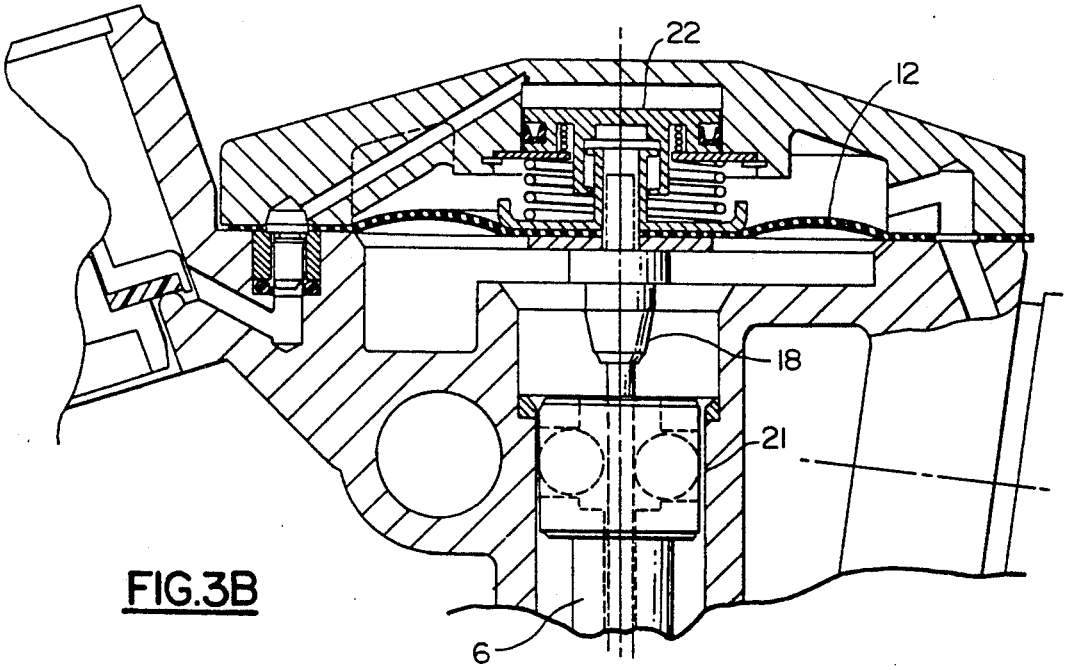
FIG. 3B is a sectional view identical to FIG. 3 except that the fuel valve is cut off but the fuel to the nozzle is at full pressure.

An important feature of the invention is in the method of controlling the unlatching of the ball latch after the prepay operating mode while permitting full tank shut-off function to remain operational. This is accomplished by the sliding fit between the shoulders 34 and 36 which permits the diaphragm 12 to raise the latch pin 18 even when the piston 22 is down. (see FIG. 3B)

The bleed valve function to control rates of fuel flow to and from the cylinder 28, plus the flexibility of providing nozzles with or without this feature by exchanging cover assemblies 16 and 16A, also add to the convenience of modifying existing nozzles to incorporate While one preferred embodiment of the invention has been described above, numerous modifications can be made therein without departing from the spirit of the invention.

I claim:

1. In an improved fuel dispensing nozzle for use in a system having a means for slowing and then stopping flow of fuel to the nozzle when a predetermined amount of fuel has been delivered by a fuel pump, said nozzle being of the type wherein a fuel dispensing valve is controlled by a hand-operated lever, and means is provided for automatically closing the valve when a vehicle tank is filled to a predetermined amount, pressure responsive means are provided for activating said valve closing means when fuel pressure drops below a predetermined amount, and conduit means connect nozzle fuel supply pressure to said fuel pressure responsive means, the improvement wherein said conduit means permits rapid flow of fuel to the responsive means when the nozzle fuel supply pressure rises and a slow flow of fuel from the responsive means when the nozzle fuel supply pressure drops so that said responsive means activates the valve closing means within a predetermined period of time after fuel pressure falls as the fuel flow slows and said fuel pressure responsive means permits flow of fuel substantially immediately upon supply of full fuel pressure to said nozzle.

2. In an improved fuel dispensing nozzle for use in a system having a means for slowing and then stopping flow of fuel to the nozzle when a predetermined amount of fuel has been delivered by a fuel pump, said nozzle being of the type wherein a fuel dispensing valve is controlled by a hand-operated lever, and means is provided for releasing said lever to permit automatic closing of said valve when a vehicle tank is filled to a predetermined amount; and fuel pressure responsive means are provided for activating said lever release means, and conduit means connect nozzle fuel supply pressure to said fuel pressure responsive means, the improvement wherein said conduit means permits rapid flow of fuel to the responsive means when the nozzle fuel supply pressure rises and a slow flow of fuel from the responsive means when the nozzle fuel supply pressure drops so that said responsive means activates the valve closing means only after a predetermined period of time after fuel pressure falls as the fuel flow slows, said fuel pressure responsive means being rendered ineffective to activate said lever release means substantially immediately upon supply of full fuel pressure to said nozzle.

3. The nozzle of claim 2 wherein the lever release means comprises a lever support plunger which is held in valve closing position by a latch mechanism operated by a latch pin, the position of said latch pin being controlled by both a piston responsive to fuel pressure and a diaphragm controlled by a full tank condition.

4. The nozzle of claim 3 wherein said conduit means includes a two way valve, said two way valve permitting rapid supply of fuel to said piston from the nozzle and a slow release of said fuel to the nozzle when fuel pressure in the supply falls.

5. In an improved fuel dispensing nozzle for use in a system having a means for slowing and then stopping flow of fuel to the nozzle when a predetermined amount of fuel has been delivered by a fuel pump, said nozzle being of the type wherein a fuel dispensing valve is controlled by a hand-operated lever, a lever support plunger for supporting one end of said lever, means for latching said support plunger against movement, means for releasing said latching means, first moveable means responsive to fuel supply pressure, second moveable means responsive to a full tank or vehicle tank pressure; each first and second moveable responsive means being operative to activate said latch release means upon existence of a predetermined condition to which either said first or second moveable means is responsive, and connections between said latch release means and said moveable means providing for release of said latching means whenever either of said moveable means responds to a predetermined condition; the improvement wherein said fuel supply pressure responsive means is inactivated substantially immediately upon supply of fuel to said nozzle but is activated only after a substantially longer predetermined time delay after said fuel supply is slowed.

6. The nozzle of claim 5 wherein said latch release means comprises a latch pin and said first and second moveable means comprise fuel pressure responsive surfaces connected to the latch pin and moveable in a direction coaxial with the latch pin.

7. The nozzle of claim 6 wherein the connection between said fuel pressure responsive surface and said latch pin provides limited motion therebetween.

8. The nozzle of claim 6 wherein said latch pin has a lost motion connection with respect to said fuel supply pressure responsive surface.

9. The nozzle of claim 6 wherein said latch release means comprises a latch pin coaxial with, and connected to, both a pressure responsive diaphragm and a pressure responsive piston, said piston being said first moveable means and said diaphragm being said second moveable means.

10. An improved fuel dispensing nozzle for use in a system having a means for slowing and then stopping flow of fuel to the nozzle when a predetermined amount of fuel has been delivered by a fuel pump, said nozzle being of the type wherein a fuel dispensing valve is controlled by a hand-operated lever, a lever support plunger for supporting one end of said lever, means for latching said support plunger against movement, means for releasing said latching means, a piston responsive to fuel supply pressure, a diaphragm responsive to a full tank or vehicle tank pressure; each said piston and diaphragm being operative to activate said latch release means upon existence of a predetermined condition to which said piston or said diaphragm is responsive, and connections between said latch release means and said piston and diaphragm providing for release of said latching means whenever either of said piston or diaphragm responds to a predetermined condition; said piston being inactivated substantially immediately upon supply of fuel to said nozzle but being activated only after a predetermined time delay after said fuel supply is slowed, said latch release means comprising a latch pin and said piston and diaphragm being surfaces connected to the latch pin and moveable in a direction coaxial with the latch pin, and a fuel by-pass valve providing rapid flow of fuel to said piston and slow flow of fuel from said piston.

11. The nozzle of claim 10 wherein aid by-pass valve comprises a by-pass piston which is moved by full fuel pressure away from a valve seat to permit rapid flow of fuel therepast.

12. The nozzle of claim 11 wherein said by-pass piston has a small return flow fuel passage therethrough when said by-pass piston is in engagement with its valve seat.

13. The nozzle of claim 12 wherein the return flow fuel passage is several orders of magnitude smaller than the passage provided when the by-pass piston is moved away from its seat.

14. The nozzle of claim 10 wherein said by-pass piston has a small return flow fuel passage along an edge thereof which passage is not sealed when said by-pass piston is in engagement with its valve seat.

15. The nozzle of claim 14 wherein said by-pass piston comprises a conical surface for engaging with its valve seat, and said small return flow fuel passage comprises a notch formed in said conical surface.

* * * * *

UNITED STATES PATENT AND TRADEMARK OFFICE

CERTIFICATE OF CORRECTION

PATENT NO. : 5,178,197

DATED : JANUARY 12, 1993

INVENTOR(S) : JAMES W. HEALY

It is certified that error appears in the above-identified patent and that said Letters Patent is hereby corrected as shown below:

Claim 1, Col. 5, line 16, after "amount," --fuel-- should be inserted.

Claim 11, Col. 6, line 65, "aid" should read --said--.

Signed and Sealed this

Thirtieth Day of March, 1993

*Attest:*

STEPHEN G. KUNIN

*Attesting Officer*

*Acting Commissioner of Patents and Trademarks*